US010144049B2

(12) United States Patent
Jansen et al.

(10) Patent No.: US 10,144,049 B2
(45) Date of Patent: Dec. 4, 2018

(54) TOOL WHICH IS MOVABLE IN AN APPARATUS

(71) Applicant: Wila B.V., Lochem (NL)

(72) Inventors: Thomas Jan Herbert Jansen, Markelo (NL); Franciscus Wilhemus Rouweler, Arnhem (NL)

(73) Assignee: Wila B.V., Lochem (NL)

( * ) Notice: Subject to any disclaimer, the term of this patent is extended or adjusted under 35 U.S.C. 154(b) by 850 days.

(21) Appl. No.: 14/407,641

(22) PCT Filed: Jul. 8, 2013

(86) PCT No.: PCT/NL2013/050513

§ 371 (c)(1),
(2) Date: Dec. 12, 2014

(87) PCT Pub. No.: WO2014/007640

PCT Pub. Date: Jan. 9, 2014

(65) Prior Publication Data

US 2015/0165506 A1 Jun. 18, 2015

(30) Foreign Application Priority Data

Jul. 6, 2012 (NL) ..... 2009141
Aug. 22, 2012 (NL) ..... 2009340

(51) Int. Cl.
*B21D 37/04* (2006.01)
*B21D 37/14* (2006.01)
(Continued)

(52) U.S. Cl.
CPC ..... *B21D 37/14* (2013.01); *B21D 5/01* (2013.01); *B21D 5/0209* (2013.01);
(Continued)

(58) Field of Classification Search
CPC ..... B21D 5/01; B21D 5/0209; B21D 5/0218; B21D 5/0227; B21D 37/06; B21D 37/04; B21D 5/02; B21D 5/0236; B21J 13/08
(Continued)

(56) References Cited

U.S. PATENT DOCUMENTS 5,146,774 A 9/1992 Smith
5,174,015 A 12/1992 Okamoto
(Continued)

FOREIGN PATENT DOCUMENTS

EP 1529571 A1 5/2005
EP 1762310 A1 3/2007
(Continued)

OTHER PUBLICATIONS

Office Action, and translation thereof, from counterpart Japanese Application No. 2015-520097, dated Jan. 31, 2017, 11 pp.
(Continued)

*Primary Examiner* — David B Jones
(74) *Attorney, Agent, or Firm* — Shumaker & Sieffert, P.A.

(57) ABSTRACT

The invention relates to a tool for shaping a material, in particular for bending plate material, comprising a mounting part configured to be in any case partially received in a receiving space of an apparatus, and a shaping part extending from the mounting part. The tool is provided with means for displacing the mounting part in longitudinal direction through the receiving space. The tool can thus be handled and positioned easily even when it is relatively heavy. The displacing means can comprise one or more displacing members protruding from the tool, for instance rollers or wheels. The invention also relates to a combination of an apparatus and such a tool, wherein the apparatus has a receiving space in which the mounting part of the tool is
(Continued)

Figure 1:
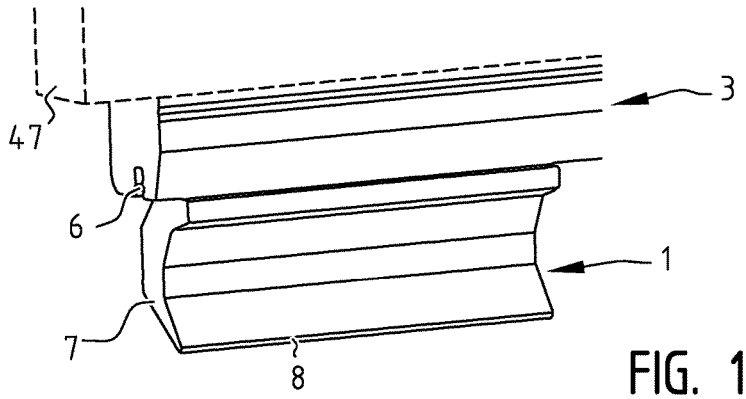

received. The receiving space here comprises a wall part on which the displacing means engage. Finally, the invention further relates to a method for positioning a tool as described above in an apparatus.

30 Claims, 16 Drawing Sheets

(51) Int. Cl.
*B21D 5/02* (2006.01)
*B21D 5/01* (2006.01)
*B21D 37/06* (2006.01)

(52) U.S. Cl.
CPC ..... *B21D 5/0218* (2013.01); *B21D 5/0227* (2013.01); *B21D 37/06* (2013.01); *Y10T 29/49895* (2015.01)

(58) Field of Classification Search
USPC ..... 72/429
See application file for complete search history.

(56) References Cited

U.S. PATENT DOCUMENTS 5,245,854 A 9/1993 Bruggink et al.
6,467,327 B1 * 10/2002 Runk ..... B21D 5/0209 72/389.9
7,168,286 B1 1/2007 Pelech
7,634,935 B2 * 12/2009 Mazzocchi ..... B21D 5/0209 72/389.3
8,141,408 B2 * 3/2012 McCauley ..... B21D 37/145 72/461
2005/0132772 A1 6/2005 Harrington et al.

FOREIGN PATENT DOCUMENTS

JP 53132457 A 11/1978
JP 57199523 A 12/1982
JP 0491833 A 3/1992
JP 04294822 A 10/1992
JP 2002134973 A 5/2002

OTHER PUBLICATIONS

International Preliminary Report on Patentability for corresponding PCT Application No. PCT/NL2013/050513, dated Jan. 6, 2015 (6 pgs.).
International Search Report for corresponding PCT Application No. PCT/NL2013/050513, dated Oct. 17, 2013 (4 pgs.).
Written Opinion for corresponding PCT Application No. PCT/NL2013/050513, dated Oct. 17, 2013 (5 pgs.).
Written Argument, and translation thereof, from counterpart Japanese Patent Application No. 2015/520097, filed on Jul. 28, 2017, 14 pp.
Decision of Refusal, and translation thereof, from counterpart Japanese Patent Application No. 2015/520097, dated Nov. 17, 2017, 11 pp.

* cited by examiner

TOOL WHICH IS MOVABLE IN AN APPARATUS

This application is a national stage entry under 35 U.S.C. § 371 of PCT Application No. PCT/NL2013/050513, filed Jul. 8, 2013, which claims the benefit of NL Application No. 2009141, filed Jul. 6, 2012 and NL Application No. 2009340, filed Aug. 22, 2012. The entire content of each of PCT Application No. PCT/NL2013/050513, NL Application No. 2009141 and NL Application No. 2009340 are incorporated herein by reference.

The invention relates to a tool for shaping a material, in particular for bending plate material, comprising a mounting part configured to be at least partially received in a receiving space of an apparatus and a shaping part extending from the mounting part. Such a tool is known, for instance from the earlier European patent 1 864 752 of applicant.

In this older patent two variants of the known bending tool are shown, an upper tool and a lower tool. The known upper tool comprises an upward directed mounting part configured for clamped suspension in an upper beam of a bending apparatus, such as a press brake. The upper tool further has a downward directed shaping part in the form of a bending edge. The known lower tool has a downward directed mounting part configured for placing and, if desired, clamping in a lower beam of the apparatus. In addition, it has an upward directed shaping part which co-acts with the downward directed shaping part of the upper tool. This shaping part takes the form of a groove into which the bending edge can be pressed. The positions of the upper tool and lower tool can otherwise also be switched so that the bending edge is pressed into the groove from the underside.

The tool as described in this older patent is used mainly to shape relatively thin plate material with a maximum plate thickness of 10 mm. The tool can then also take a relatively small and light form and can be handled by a user without a great deal of effort. When a tool has to be replaced, the user can place the tool in or remove it from the apparatus manually.

Larger and heavier tools are however required for shaping greater plate thicknesses. Tools suitable for bending plate thicknesses of for instance 20 mm thus weigh in the order of 200 kg per meter of length. Although considerably shorter tools are often applied, weights of between 50 and 100 kg are then still no exception. Such tools can no longer be handled properly by a user. Different systems have therefore already been proposed for placing heavy tools in or removing them from an apparatus.

The Japanese patent publication 57199523 thus describes an upper beam for attaching in an apparatus a tool in which is formed a receiving space of cross-shaped cross-section. The receiving space is formed by a vertically running main space and two side spaces on either side of the main space. In this older system the tool is mounted on a slide with a vertical part extending in the main space and two horizontally protruding parts extending in the side spaces. Arranged in the bottoms of the two side spaces are rollers over which the horizontal parts of the slide can travel. A slide with a tool mounted thereon can in this way be carried from the side into the upper beam.

In another known system which is described in the U.S. Pat. No. 5,146,774 a lower beam of an apparatus is provided with rollers in the bottom of the receiving space for the tool. These rollers can be moved upward until they protrude above the bottom surface, following which a tool can be moved thereover.

The known constructions have the drawback that they are relatively large and complicated. The beam is moreover weakened at the position of the recesses in which the rollers have to be bearing-mounted, this entailing the risk of local deformation of the clamping beams. This could in turn result in a non-uniform shaping of the material.

The invention therefore has for its object to provide a solution for the problems outlined above. This is achieved according to the invention by providing a tool of the above described type with means for displacing the mounting part in longitudinal direction through the receiving space. The longitudinal direction is understood here to mean the direction parallel to the bending edge and groove of the tools. Using such displacing means the tool can be placed at a desired position in the apparatus or taken out of the apparatus with little effort. The tool can thus also be placed in or removed from a storage area in simple manner. Because the displacing means form part of the tool itself, no modifications of the apparatus or the storage area are necessary for this purpose.

The displacing means preferably comprise at least one member protruding from the tool. Such a displacing member can support on a surface of the apparatus and move thereover.

When the at least one displacing member protrudes from the mounting part, it can move along a surface in the receiving space.

In an embodiment of the tool the mounting part has two side surfaces and the at least one displacing member protrudes outside at least one of the side surfaces.

At least one displacing member then preferably protrudes outside each side surface. A stable movement of the tool is thus ensured. An upper tool can be as it were suspended here from the displacing members during its movement through the receiving space in the upper beam. A structurally simple embodiment is achieved in this case when the tool is provided with a single displacing member running through the mounting part.

The at least one displacing member is preferably retractable into the mounting part. The displacing member can thus simultaneously serve as safety catch which prevents the tool falling out of the apparatus when the clamping is released. The tool can be provided here with an operating member, for instance a pushbutton, which is connected to the at least one displacing member and with which the displacing member is retracted. Biasing means, for instance in the form of a spring, can ensure that the displacing member is always urged toward its protruded position.

It is on the other hand also readily possible to envisage the mounting part having an end surface where the at least one displacing member protrudes. A lower tool can thus be moved through the receiving space in the lower beam while resting on its displacing member. In the case of an upper tool, it can be suspended from its displacing members when the displacing member additionally protrudes outside the side surfaces of the tool. This can for instance be envisaged in the case of so-called American style tooling.

In this case the at least one displacing member can be movable in the shaping direction relative to the tool. The displacing member can thus as desired be brought into contact with a wall part of the receiving space so as to be displaced therealong or, conversely, be held clear of the wall part when the tool has reached a desired position and is there clamped.

It is also possible to envisage the at least one displacing member protruding from the shaping part. The displacing member can then be moved along an outer surface of the apparatus, while its dimensions are in this case not limited by the dimensions of the receiving space in the apparatus. The displacing member can hereby take a more robust form.

In a preferred embodiment the tool according to the invention is provided with at least one displacing member protruding from the mounting part and at least one displacing member protruding from the shaping part. This combination provides for smooth running with little friction.

For a stable support thereof, the tool preferably has a number of protruding displacing members distributed in longitudinal direction of the tool.

In order to minimize the resistance during the movement of the tool, the at least one displacing member can be mounted rotatably in the tool. The displacing member can thus be embodied as roller or wheel.

The at least one displacing member can thus comprise a rod received in a bore in the tool via an external bearing. This is a compact and structurally simple solution which is particularly suitable for an upper tool.

It is on the other hand also possible to envisage the at least one displacing member comprising a roller arranged rotatably on a shaft via an internal bearing.

The at least one displacing member is preferably rotatable here about an axis extending in transverse direction of the tool and transversely of the shaping direction of the tool. The displacing member(s) can thus roll in longitudinal direction through the receiving space while rotating about a lying axis.

It is on the other hand also possible to envisage the at least one displacing member being rotatable about an axis extending in the shaping direction of the tool, thus a standing axis. The displacing member(s) can then roll along a vertical wall part of the receiving space.

A very good guiding of the movement of the tool along mutually perpendicular wall parts of the receiving space is achieved when the tool is provided with at least two displacing members, one of which is rotatable about an axis extending in transverse direction of the tool and transversely of the shaping direction of the tool and another of which is rotatable about an axis extending in the shaping direction of the tool.

The invention further relates to a combination of an apparatus and a tool as described above, wherein the apparatus has a receiving space in which the mounting part of the tool is received. The invention has for its object to provide such a combination in which the tool can be moved in simple manner. This is achieved according to the invention in that the receiving space comprises a wall part on which the displacing means engage.

In order to prevent the displacing means being loaded when the tool is clamped, it is recommended that the apparatus and the tool are configured to hold the displacing means clear of the wall part during shaping.

The wall part and the displacing means can for this purpose be movable relative to each other between a rest position, in which they lie spaced apart, and an operative position in which the displacing means engage on the wall part.

The displacing means are then preferably received in stationary manner in the tool and the wall part is movable in the apparatus between the rest position and the operative position. The tool, which is small and requires a small investment compared to the apparatus, can thus take a relatively simple form.

A drive can be provided for the purpose of moving the wall part between the rest position and the operative position. This movement can thus be effected quickly and effortlessly. The drive can be of pneumatic, hydraulic or mechanical nature.

Finally, the invention relates to a method for positioning in an apparatus a tool comprising a mounting part and a shaping part extending from the mounting part by at least partially receiving the mounting part in a receiving space of the apparatus and moving the tool in longitudinal direction to a desired position. Such a method is known—in any case implicitly—from some of the above stated documents.

The method according to the invention is distinguished from the known methods in that, before being received, the tool is provided with displacing means and the mounting part is moved in longitudinal direction through the receiving space by means of the displacing means.

Preferably applied variants of the method according to the invention are described in the dependent claims.

Figure 2:
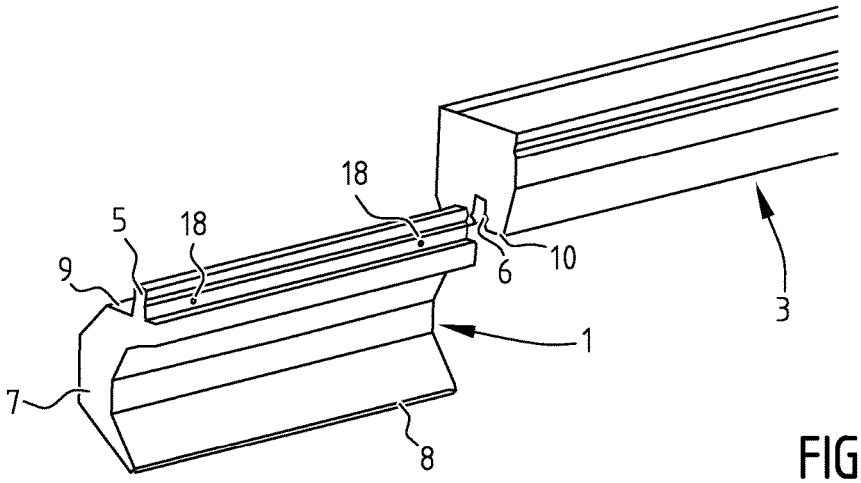
Figure 4:
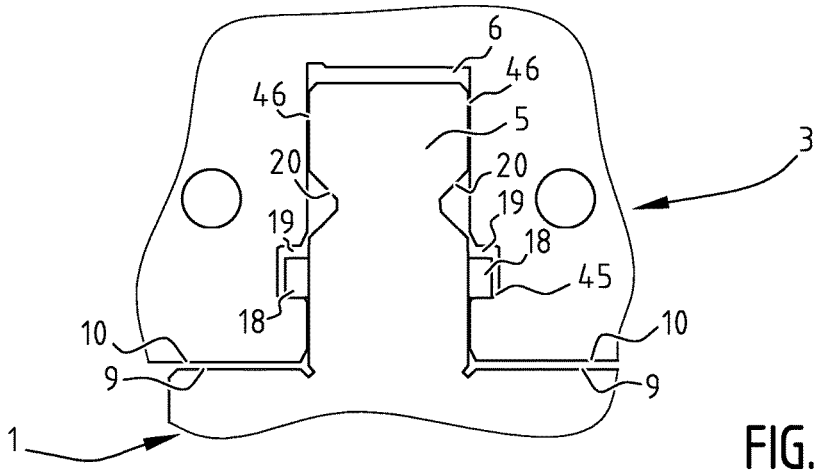
Figure 3:
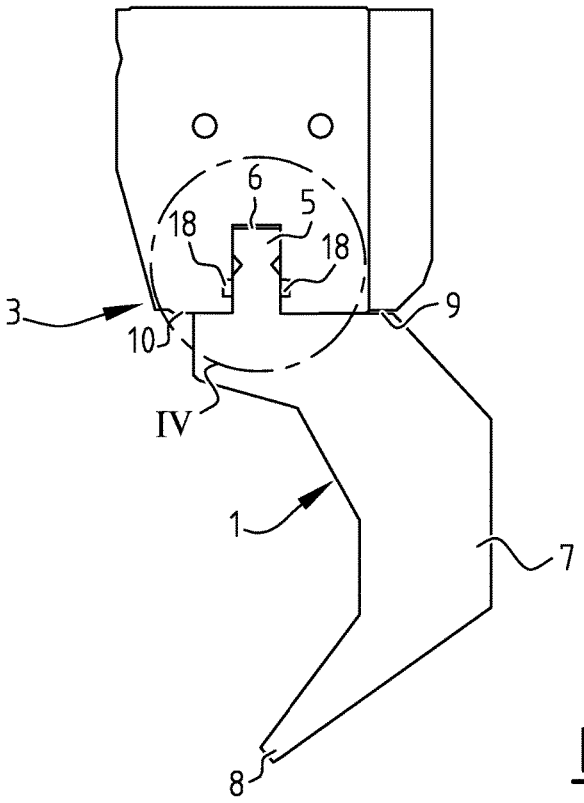
Figure 5:
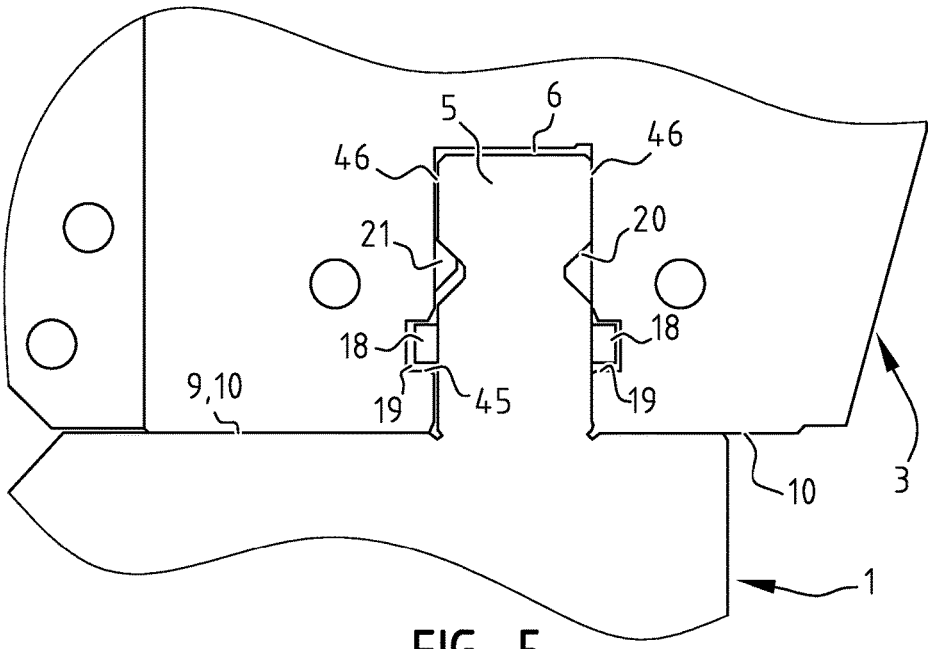
Figure 6:
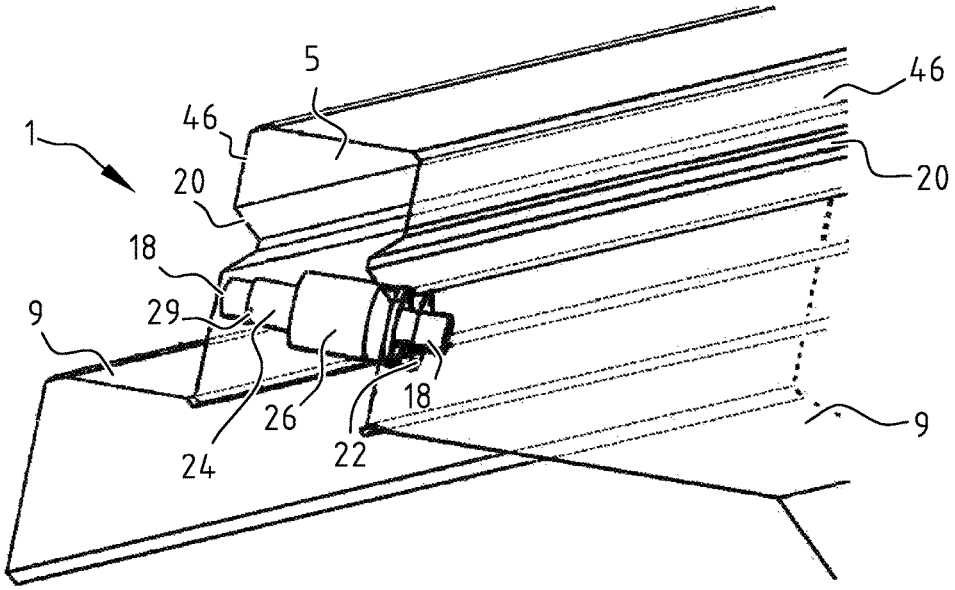
Figure 7:
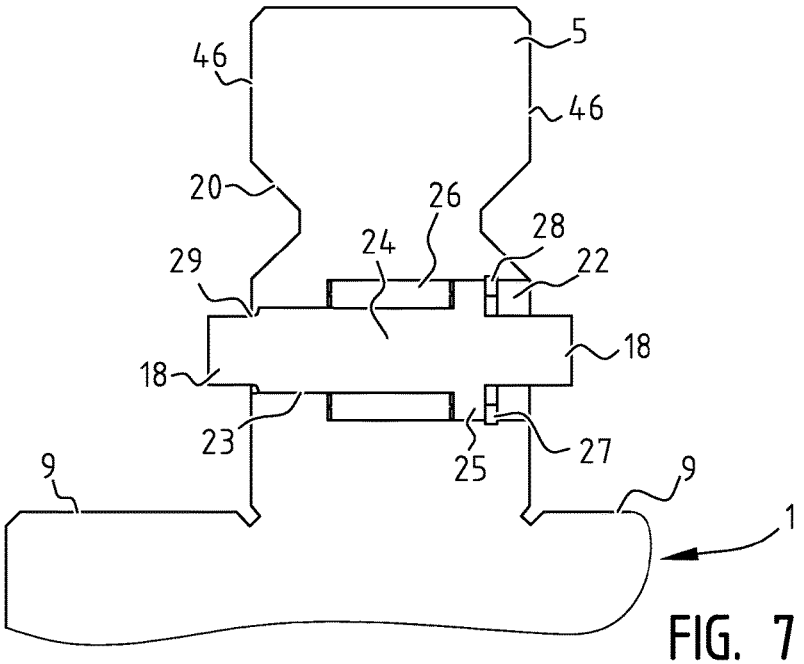
Figure 8:
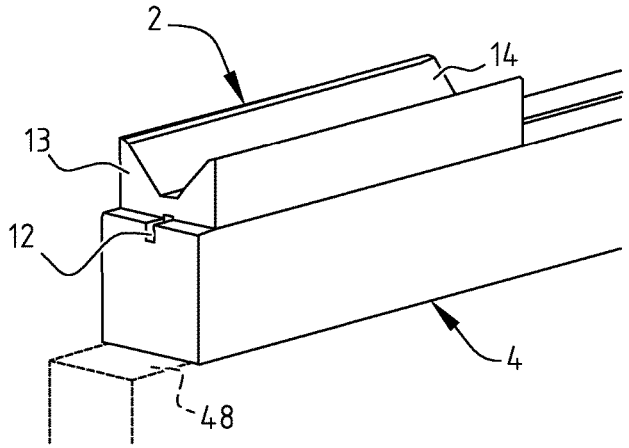
Figure 9:
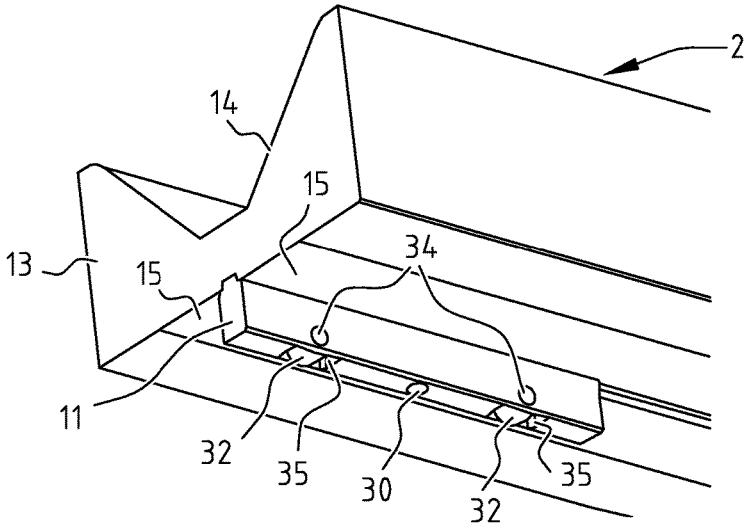
Figure 10:
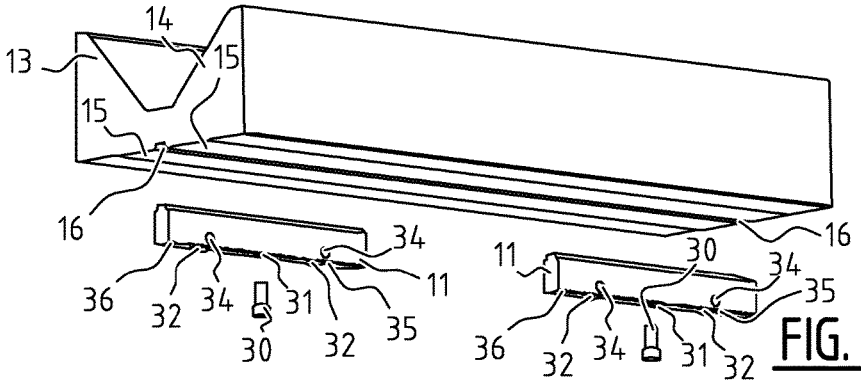
Figure 11:
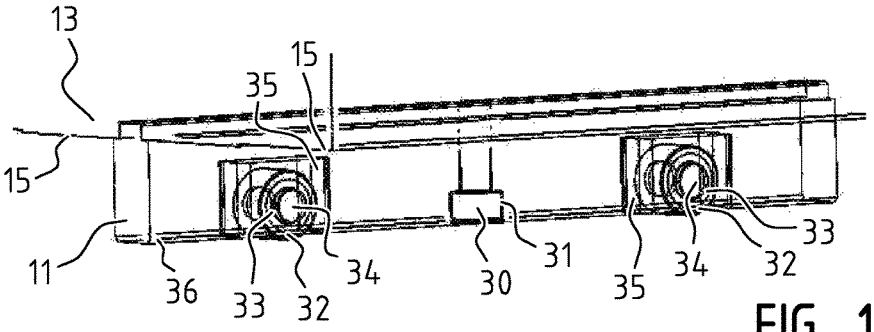
Figure 12:
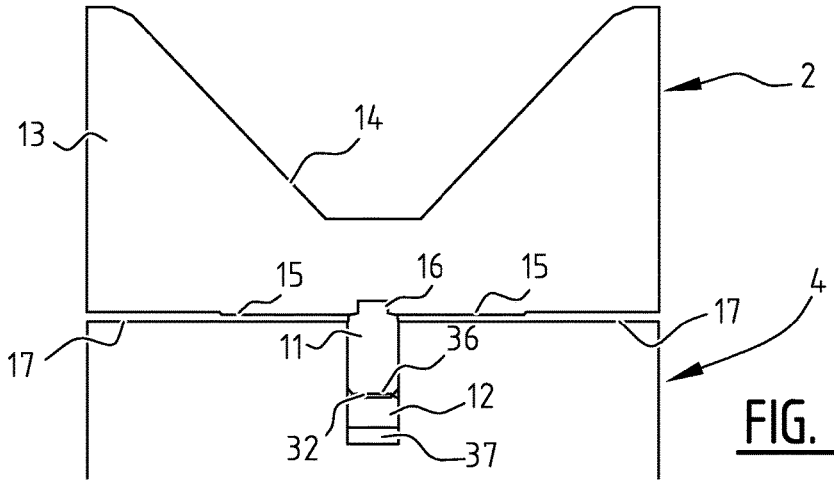
Figure 13:
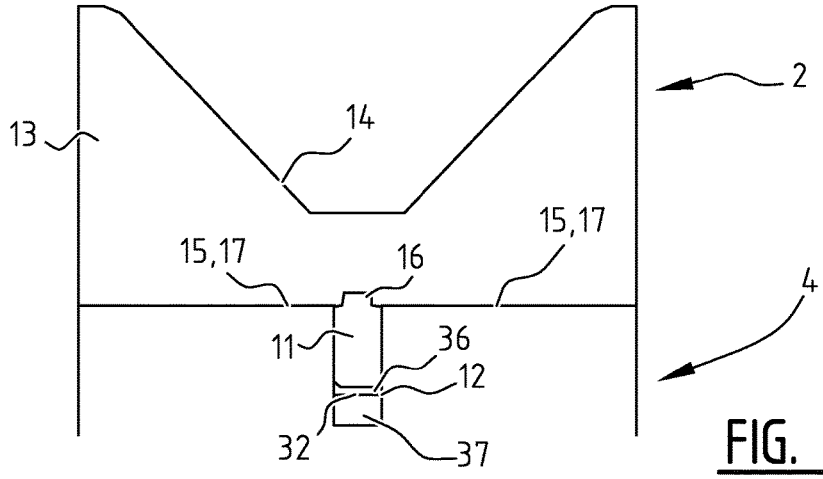
Figure 14:
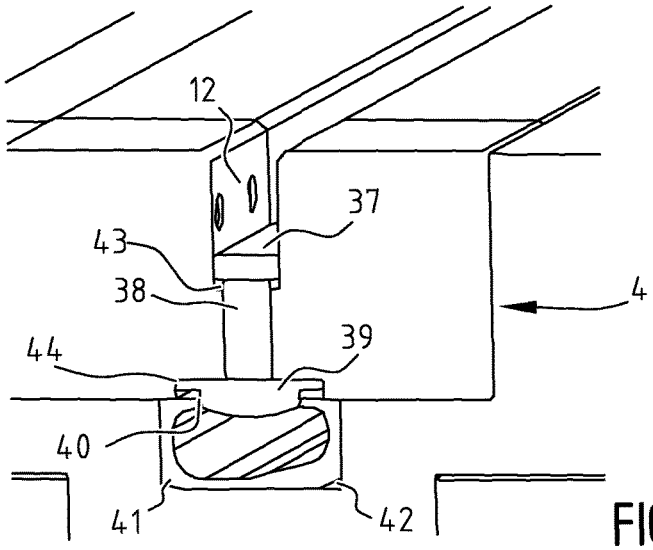
Figure 15:
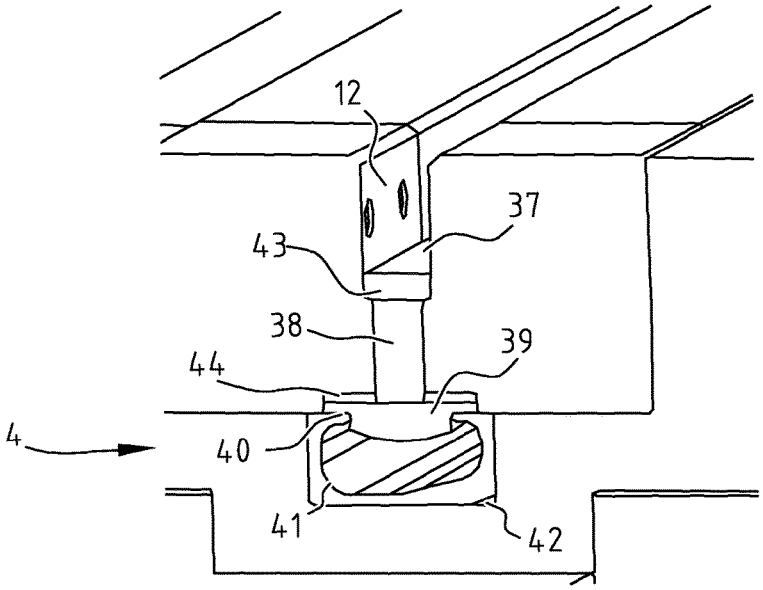
Figure 16:
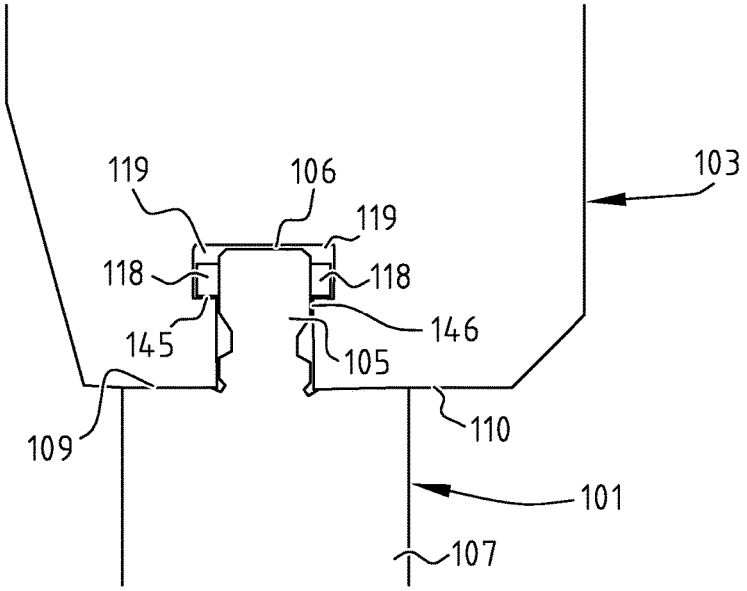
Figure 17:
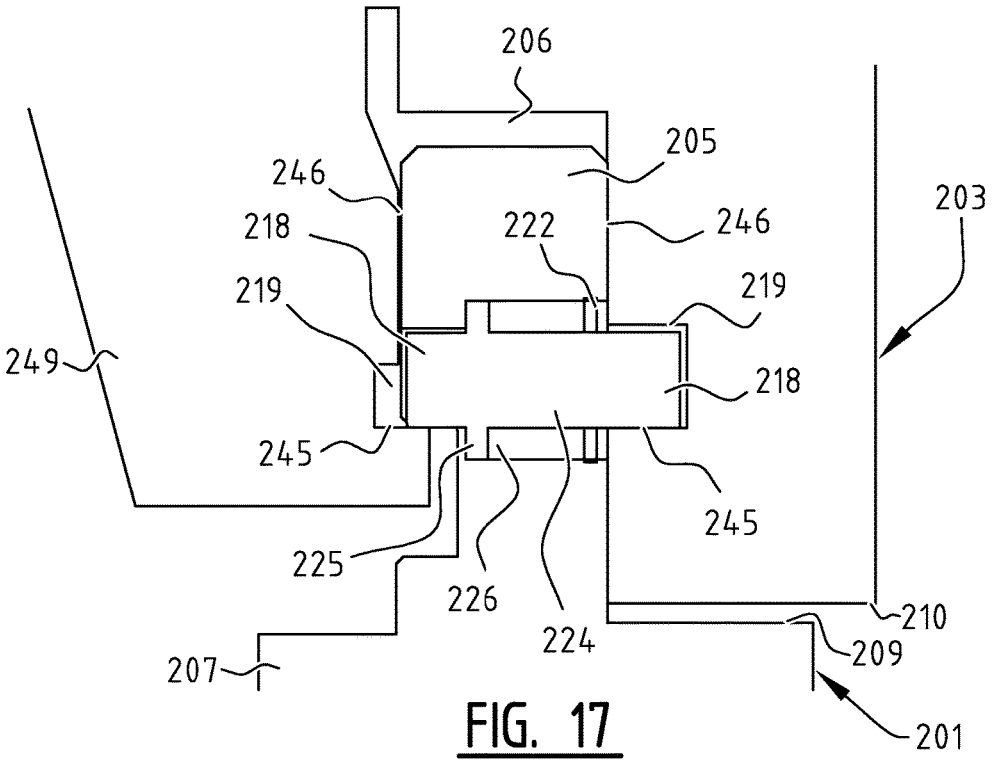
Figure 18:
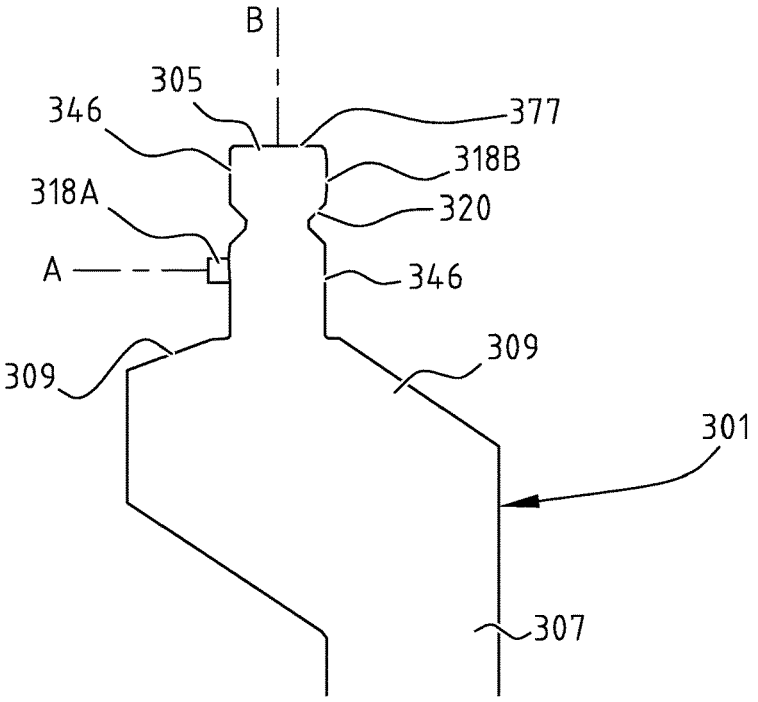
Figure 19:
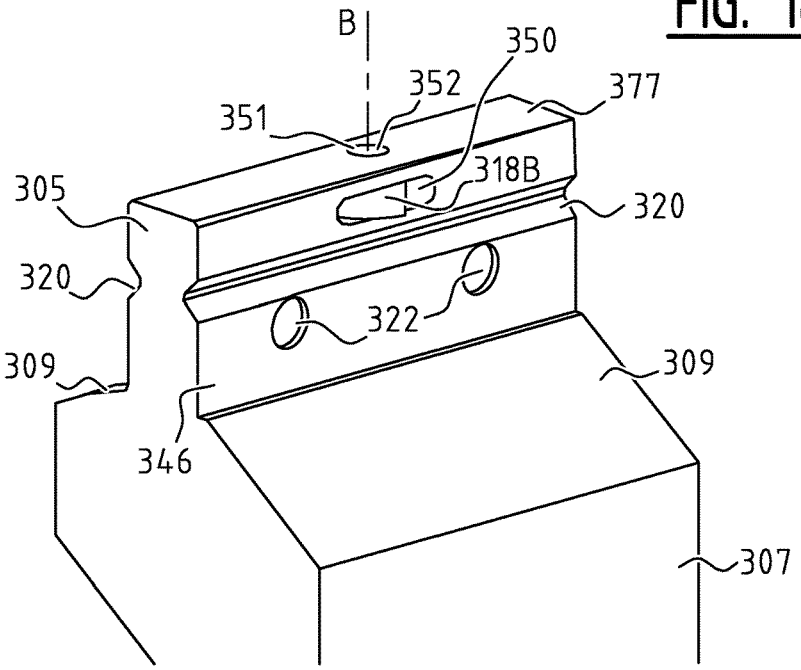
Figure 20:
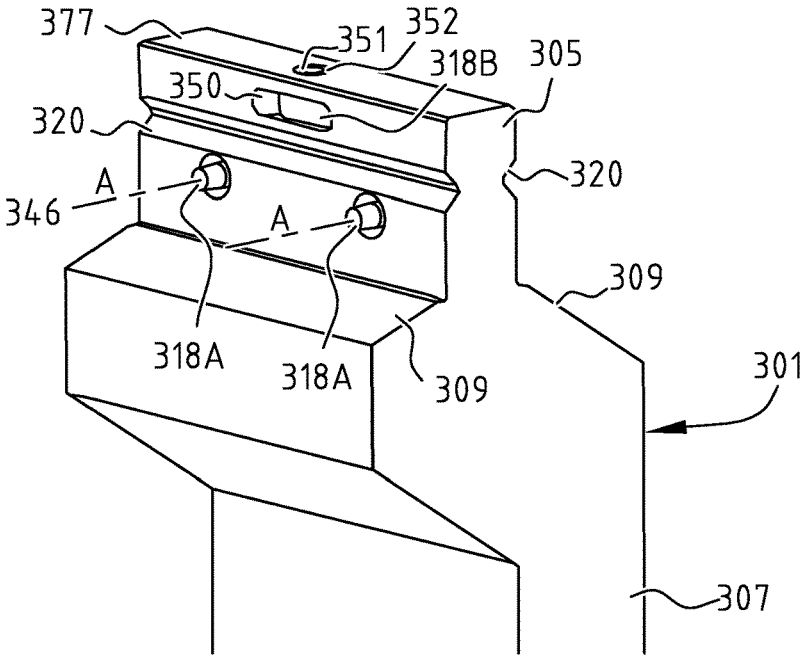
Figure 21:
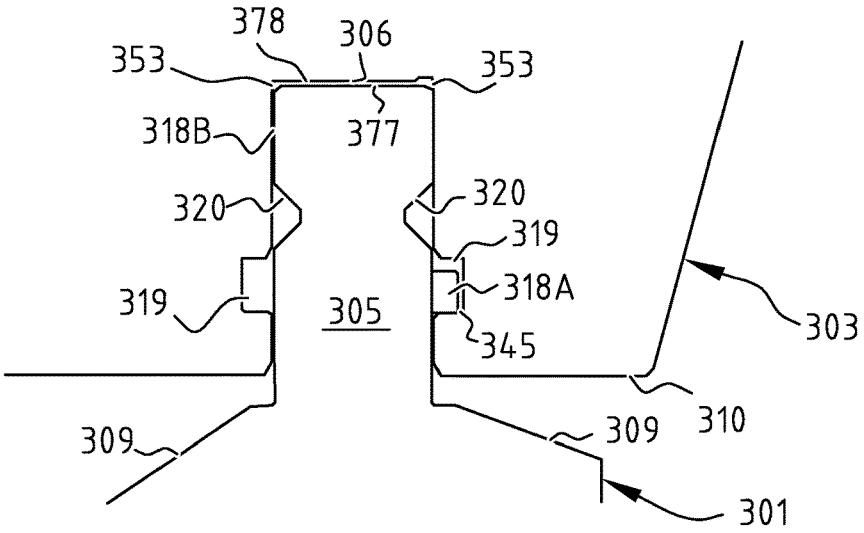
Figure 22:
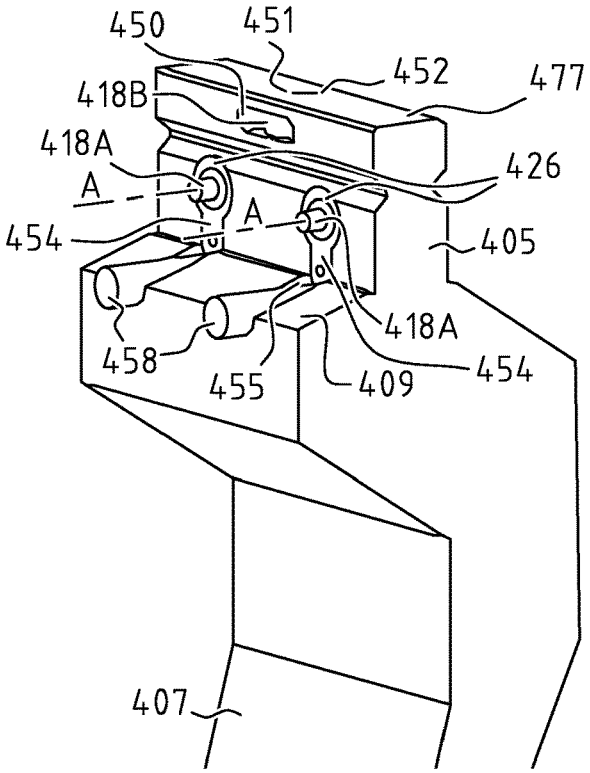
Figure 23:
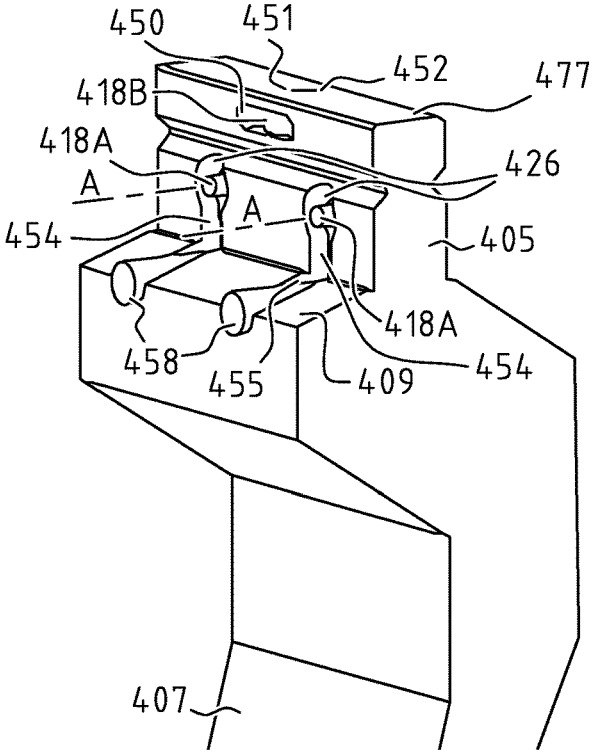
Figure 24A:
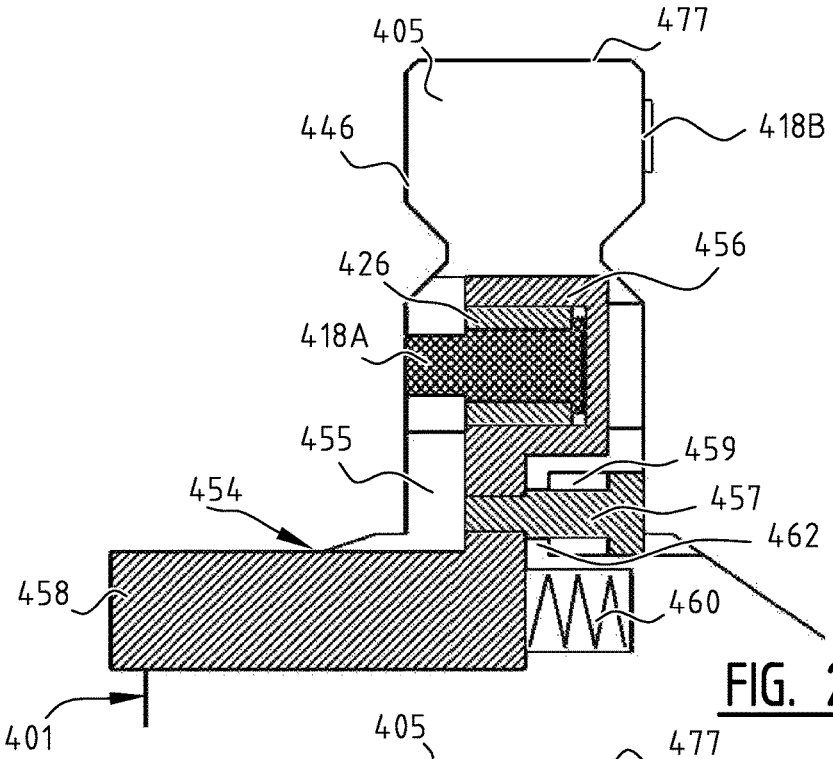
Figure 24B:
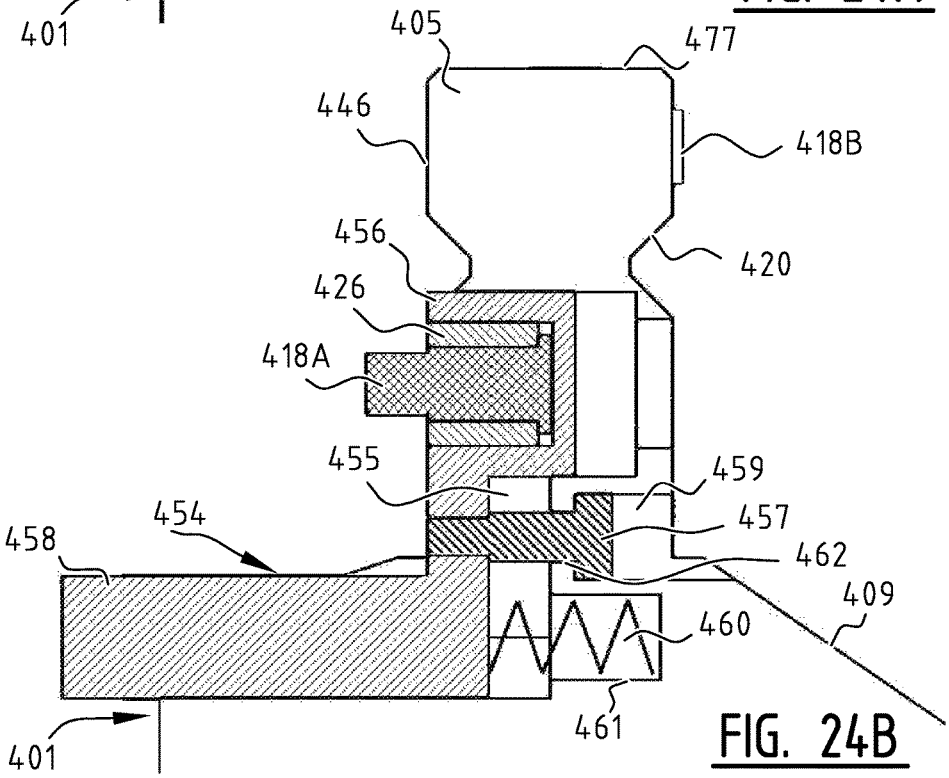
Figure 25:
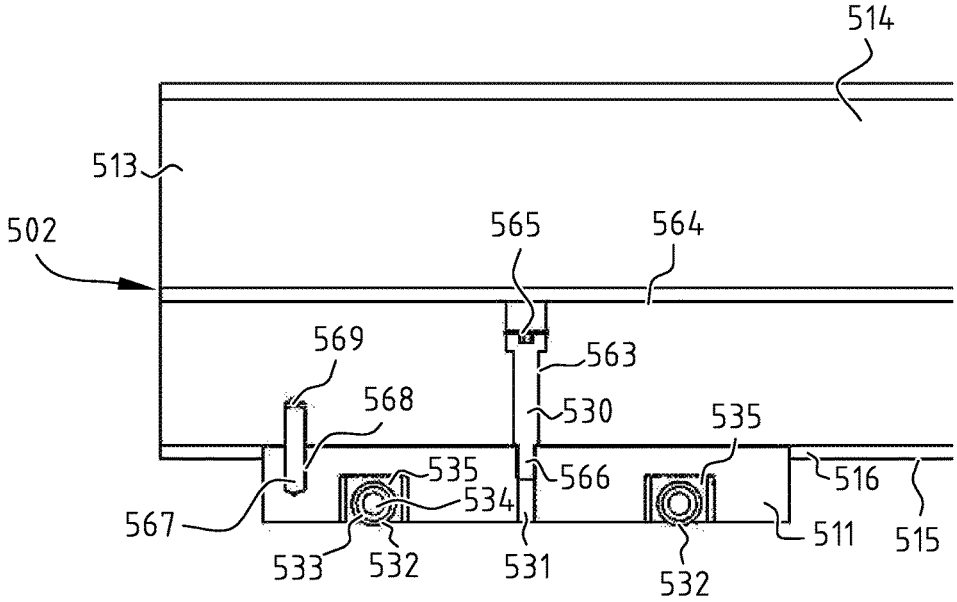
Figure 26:
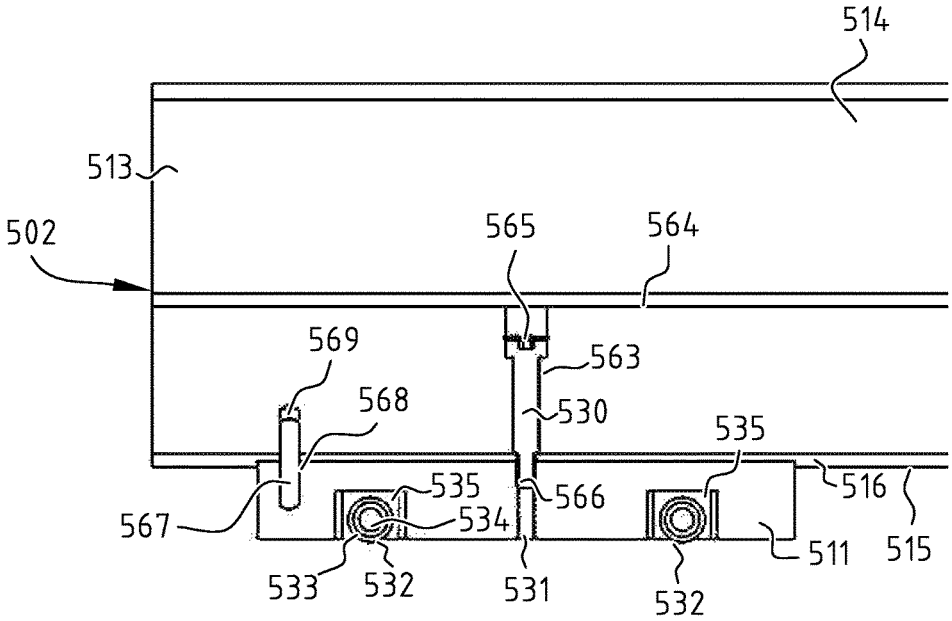
Figure 27:
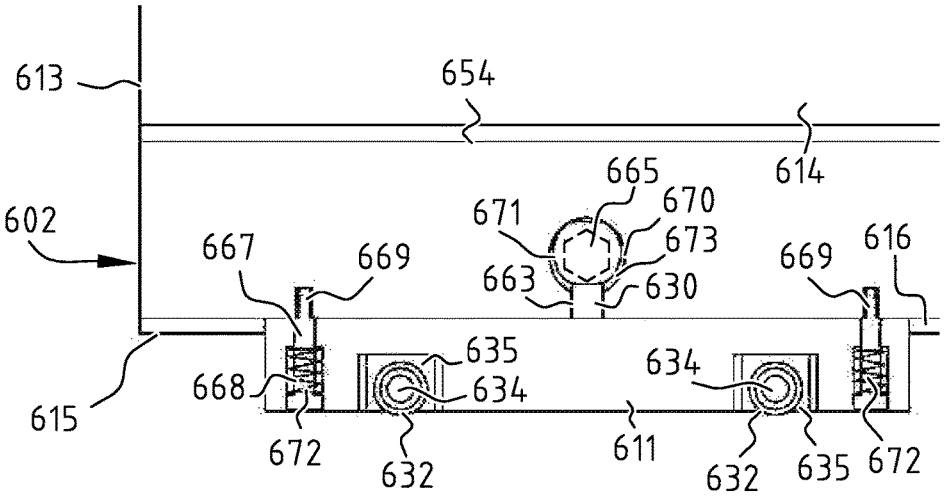
Figure 28:
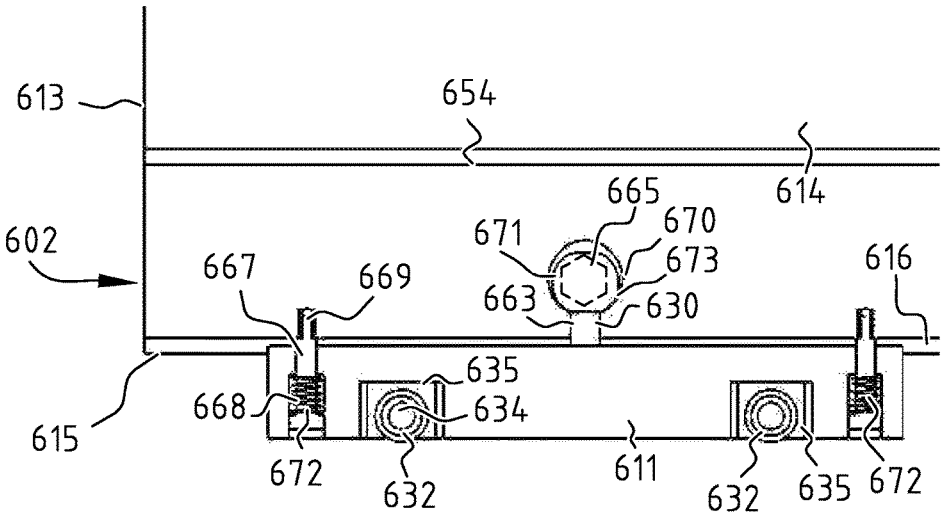
Figure 29:
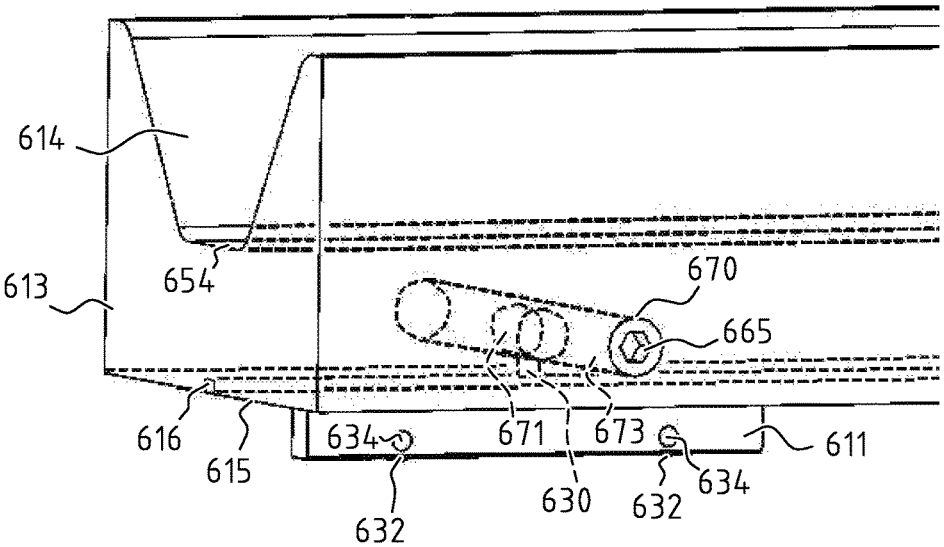
Figure 30:
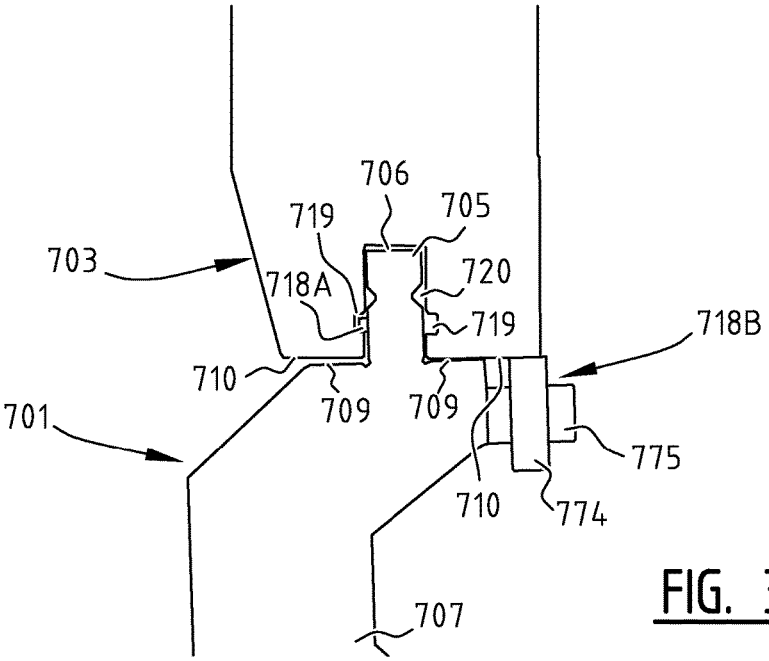
Figure 31:
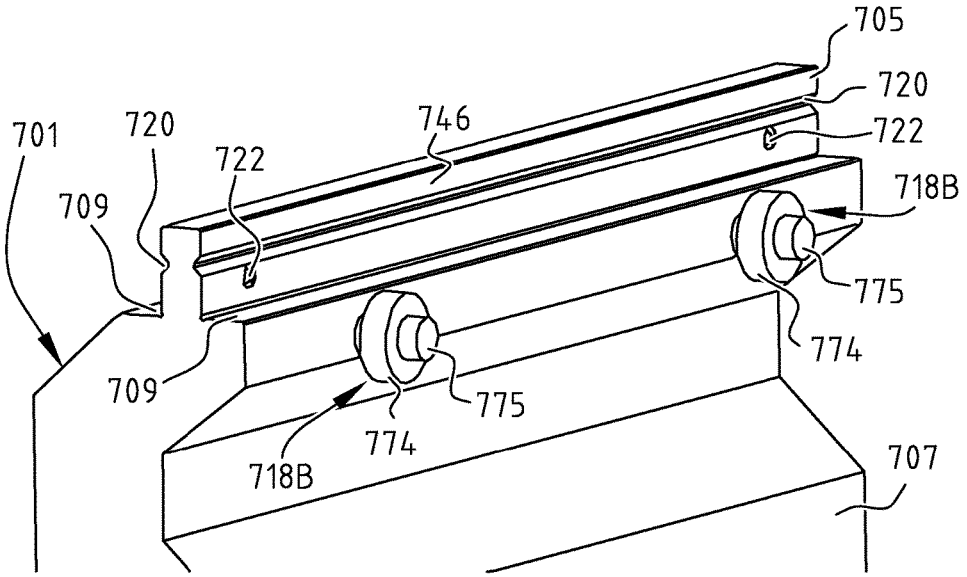
Figure 32:
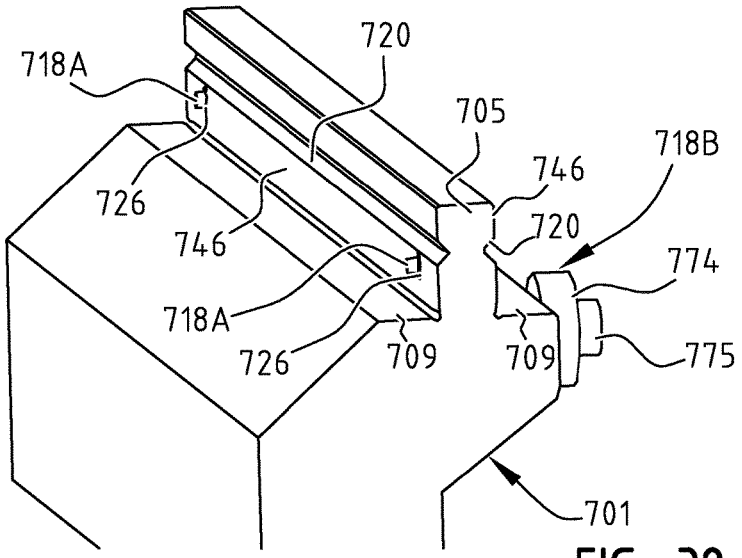
Figure 33:
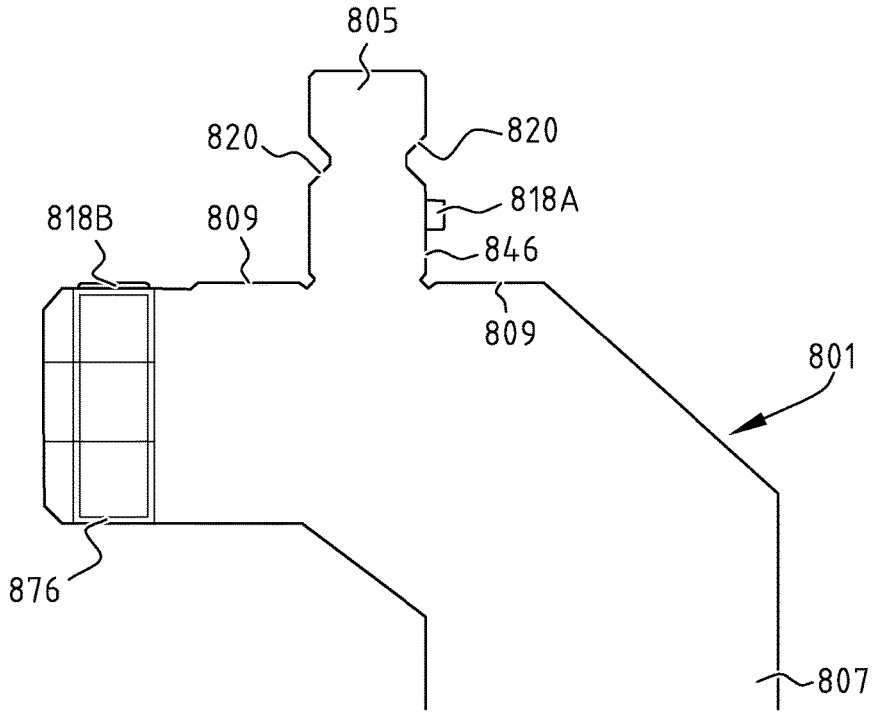
Figure 34:
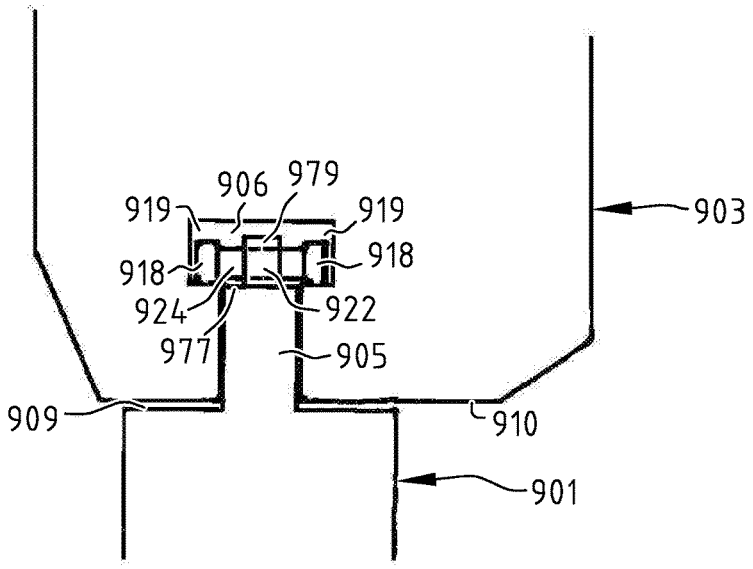

The invention will now be elucidated on the basis of a number of embodiments, wherein reference is made to the accompanying drawing in which corresponding components are designated with reference numerals increased in each case by 100, and in which:

FIG. 1 is a perspective view of a part of an upper beam of an apparatus with an upper tool clamped therein for the purpose of bending metal plate according to a first embodiment of the invention, FIG. 2 is a perspective view of the upper beam and the tool of FIG. 1 in separated position, FIG. 3 shows a cross-section of the upper beam with the upper tool received therein in the separated position, in which the tool is freely displaceable, FIG. 4 shows on enlarged scale a detail according to the circle IV in FIG. 3, FIG. 5 shows a cross-section through the upper beam and the tool from another side, wherein the tool is shown in the clamped situation, FIG. 6 is a cut-away perspective view of the mounting part of the tool and a displacing member received therein, FIG. 7 is a cross-section through the part of the tool shown in FIG. 6, FIG. 8 is a perspective view of a lower beam with a lower tool according to another embodiment of the invention received therein, FIG. 9 is a perspective bottom view of a part of the lower tool of FIG. 8, FIG. 10 is a perspective bottom view of the lower tool of FIGS. 8 and 9 with exploded parts, FIG. 11 is a cut-away perspective detail view showing the displacing members of the lower tool, FIG. 12 shows a cross-section through the lower beam with the lower tool in the freely displaceable position, FIG. 13 is a cross-section corresponding to FIG. 12 in which the tool is shown in fixed situation, FIG. 14 shows a perspective cross-section of the lower beam with raised bottom of the receiving space for the lower tool, FIG. 15 shows a view corresponding to FIG. 14 of the lower beam with the bottom of the receiving space in its rest position, FIG. 16 is a view corresponding to FIG. 5 in which a so-called "American style" tool is shown with displacing members protruding on either side, FIG. 17 is a view corresponding to FIG. 4 which shows a so-called "European style" tool with a displacing member protruding on two sides, FIG. 18 is a side view of an alternative embodiment of the upper tool according to the invention, with a displacing member rotatable about a lying axis and a displacing member rotatable about a standing axis, FIG. 19 is a perspective rear view of the tool of FIG. 18, FIG. 20 is a perspective front view of the tool of FIG. 18, FIG. 21 shows the tool of FIGS. 18-20 with the mounting part in the receiving space of the upper beam, as seen from the other side, FIG. 22 is a perspective front view of yet another embodiment of the upper tool according to the invention, wherein apart of the displacing members is retractable into the mounting part, FIG. 23 is a view corresponding to FIG. 22 with the displacing members in retracted position, FIGS. 24A and 24B show cross-sections through the tool of FIGS. 22 and 23 with retracted and extended displacing members, FIG. 25 shows a cross-section through an alternative embodiment of the lower tool, wherein the displacing members are movable in the shaping direction relative to the rest of the tool, FIG. 26 is a view corresponding to FIG. 25 in which the displacing members have been moved downward relative to the rest of the tool, FIG. 27 is a cross-section corresponding to FIG. 25 showing a variant of the tool with displacing means movable in height direction, FIG. 28 is a view corresponding to FIG. 27 in which the displacing members have been moved downward relative to the rest of the tool, FIG. 29 is a perspective view of the lower tool of FIGS. 27 and 28, FIG. 30 is a view corresponding to FIG. 21 of yet another embodiment of the upper tool according to the invention, wherein a part of the displacing members is arranged outside the receiving space, FIG. 31 is a perspective rear view of the upper tool of FIG. 30, FIG. 32 is a perspective front view of the tool of FIGS. 30 and 31, FIG. 33 is a side view of yet another embodiment of the upper tool according to the invention, and FIG. 34 is a view corresponding to FIG. 16 of an "American style" tool with displacing members protruding from the upper side.

In an apparatus (not shown here) for shaping a material, in particular for bending plate material, use is made of an upper tool 1 (FIG. 1) and a lower tool 2 (FIG. 8). Upper tool 1 is attached here in an upper clamping beam 3 which is in turn mounted on a (schematically shown) upper frame 47 of the apparatus, while lower tool 2 is received in a lower clamping beam 4 which is likewise mounted on a lower frame 48 of the apparatus. Upper and lower clamping beams 3, 4 can otherwise also form an integral part of respectively upper frame 47 and lower frame 48. The apparatus, which is also known as a press brake, is provided with a drive whereby the upper and lower frames 47, 48 with the upper and lower clamping beams 3, 4 mounted thereon can be moved toward each other with force in order to bend apiece of plate material placed between lower tool 2 and upper tool 1 to a desired angle. Lower frame 48 with lower beam 4 and lower tool 2 will in many cases be held in place here, and upper frame 47 with upper beam 3 and upper tool 1 will be moved downward.

Upper tool 1 comprises a mounting part 5 configured to be received in a receiving space 6 of upper beam. 3 (FIG. 3). This receiving space 6 takes the form of an elongate recess or groove extending over the whole length of upper beam 3. In addition, the tool comprises a shaping part 7 extending in the direction of the lower beam from mounting part 5. This shaping part 7 has a roughly C-shaped cross-section here and ends in a bending edge 8. Tool 1 has two shoulders 9 on either side of mounting part 5 which during use come into engagement with support surfaces 10 on the underside of upper beam. 3 so as to transmit the pressure forces in evenly distributed manner into tool 1.

In the shown embodiment lower tool 2 comprises two mounting parts 11 configured to be received in a receiving space 12 in lower beam 4 of the apparatus (FIG. 10). This receiving space 12 is also an elongate recess or groove and extends over the length of lower beam 4. Lower tool 2 additionally comprises a shaping part 13 provided in the shown embodiment with a substantially V-shaped groove 14 directed toward upper tool 1. Lower tool 2 further has two shoulders 15 extending on either side of a groove 16 in which the mounting parts 11 are fixed. During use of the apparatus and the tool these shoulders 15 rest on support surfaces 17 of lower beam 4 of the apparatus. Just as upper tool 1, lower tool 2 could also have a mounting part formed integrally with the rest of the tool.

The apparatus and tools 1, 2 are particularly intended for the purpose of shaping relatively thick metal plate with a material thickness in the order of 10 mm or more. This results in tools 1, 2 taking a relatively large and heavy form. Tools which are suitable for bending such thick metal plates often weigh in the order of 200 kg per running meter. These bending tools are generally supplied in different length sizes for the purpose of shaping materials with varying dimensions. A plurality of tools can for instance be placed adjacently of each other here in the press brake. However, even relatively short tools of for instance 50 cm already have a weight of about 100 kg and cannot therefore be handled by a user without auxiliary means.

The invention therefore provides displacing means with which tools 1, 2 can be displaced in the respective receiving spaces 6, 12. The displacement is envisaged here in the longitudinal direction of receiving spaces 6, 12, so parallel to the bending edge 8 and groove 14 of tools 1, 2. In the shown embodiment the displacing means comprise displacing members 18, 32 protruding from the mounting part 5, 11 of the associated upper or lower tool 1, 2. In the shown embodiment these displacing members 18, 32 are each mounted rotatably in the corresponding mounting part 5, 11 and thus form rollers or wheels which engage on a wall part 45, 37 in the associated receiving space 6, 12.

Displacing members 18 of upper tool 1 are formed here by the outer ends of a rod 24 which is received in a throughbore 22 in mounting part 5 (FIGS. 6, 7). These outer ends 18 protrude outside side walls 46 of the mounting part. Arranged around a middle part of rod 24 is a bearing 26 which is retained by a flange 25 of rod 24. Flange 25 is in turn retained by a ring 27 which is pressed into a groove 28. Bore 22 has a narrowed portion 23 in which rod 24 is rotatable in closely-fitting manner. The bore is sealed by a gasket ring 29.

In the shown embodiment upper tool 1 is provided with two sets of displacing members 18 arranged close to the outer ends (FIG. 2).

As stated, displacing members 18 protrude outside side walls 46 of mounting part 5 of upper tool 1, between shoulders 9 and recesses 20 to be discussed below. In order to accommodate these displacing members 18 the receiving space 6 is provided with two side chambers 19, likewise extending over the length of upper beam 3. When tool 1 has to be displaced in upper beam 3, displacing members 18 move over bottoms 45 of side chambers 19 on either side of main recess 6. The height of side chambers 19 is greater than the diameter of displacing members 18, while the depth of side chambers 19 is greater than the distance the displacing members 18 protrude from side walls 46 of mounting part 5. There is thus sufficient space to hold displacing members 18 clear of bottom 45 when tool 1 is used to perform a bending operation. This prevents displacing members 18, which are relatively vulnerable, being loaded during this operation.

When tool 1 has been moved to a desired position in longitudinal direction of upper beam 3, tool 1 is fixed in the upper beam. Use is made for this purpose of a per se known clamping mechanism arranged in upper beam 3. Mounting part 5 of tool 1 is provided on either side with a recess 20 with inclining surfaces into which a clamping member 21 of the apparatus engages. When clamping member 21 protrudes into recess 20 in one of the side walls 46, it presses mounting part 5 obliquely upward in receiving space 6 (FIG. 5). Mounting part 5 is pressed so far to the side that it comes to lie against a wall of recess 6. The opposite side wall 46 of mounting part 5 can here touch a side wall of recess 6, or the upper side of the mounting part can come into contact with the upper wall of recess 6. In this situation mounting part 5 is pressed so far upward that displacing members 18 have moved clear of wall part 45, although not so far that they could come into contact with any other wall of side chambers 19. Displacing members 18 are thus not loaded.

As noted, lower tool 2 has two mounting parts 11 arranged spaced apart in longitudinal direction. In the shown embodiment the mounting parts 11 are connected releasably to shaping part 13 by means of bolts 30 running through holes 31. Each mounting part 11 is provided here with two displacing members 32 which are likewise arranged spaced apart in longitudinal direction. Each displacing member 32 takes the form of a roller arranged rotatably on a shaft 34 via a bearing 33. Displacing members 32 are received in recesses 35 in mounting part 11 and each protrude to some extent below the bottom surface 36 thereof.

When tool 2 has to be displaced in lower beam 4, displacing members 32 move over the bottom 37 of recess 12. In order to prevent displacing members 32 being loaded when lower tool 2 is clamped in lower beam 4 and is used to deform plate material, bottom 37 of recess 12 is movable such that it comes to lie clear of displacing members 32.

In the shown embodiment the movable bottom 37 rests via a coupling part 38 on a sealing strip 39 functioning as piston. This sealing strip 39 is accommodated movably in an opening 40 in the upper side of an elongate pneumatic reservoir 41 which is arranged in a recess 42 in lower beam 4. The movement of sealing strip 39 is bounded by the dimensions of another recess 44 in lower beam 4. Activation of a pneumatic system enables pressure to be applied to reservoir 41, whereby sealing strip 39 is urged upward and bottom 37 is moved upward until it comes into engagement with displacing members 32 (FIGS. 12, 14). If on the other hand the pressure is removed from reservoir 41, sealing strip 39 then drops back into opening 40 under the influence of the weight of bottom 37 and coupling part 38. Movable bottom 37 hereby drops until it comes to rest on an outer edge 43 of receiving space 12. In this position the displacing members 32 lie clear of bottom 37 (FIGS. 13, 15). Bottom 37 could otherwise also be movable hydraulically, or even mechanically, instead of pneumatically.

The above described upper tool 1 is of the type known as a "Wila style" tool, the protruding mounting part 5 of which has a specific form which ensures that the tool can be positioned and clamped quickly and easily. The invention can however also be applied in other types of tool.

FIG. 16 thus shows a so-called "American style" upper tool 101, the mounting part 105 of which is provided close to its free outer end with displacing members 118 protruding from side walls 146. These displacing members 118 are received here in two side chambers 119 of the T-shaped receiving space 106 in upper beam 103 and are moved over the bottoms 145 of these side chambers 119 when tool 101 has to be positioned. In the shown position tool 101 is otherwise clamped in upper beam 103, wherein shoulders 109 lie against support surfaces 110 and displacing members 118 lie clear of the walls of side chambers 119.

In a variant of this "American style" upper tool 901 a rod 979 protrudes from an end surface 977 of mounting part 905 (FIG. 34). This rod 979 is provided with a bore 922 in which a shaft 924 is mounted. Mounted on the outer ends of this shaft 924 are two displacing members 918 which can in turn be moved through side chambers 919 of the T-shaped receiving space 906. It would also be possible in this variant to suffice with a single displacing member 918 on a side of rod 979.

FIG. 17 shows a "European style" upper tool 201 which is clamped in a receiving space 206 defined by an upper beam 203 with a narrowed underside and a separate clamping member 249. This upper tool is also provided with displacing members 218 on either side of mounting part 205, only one of which however protrudes outside side surface 246. The other displacing member 218 only lies clear on its underside, and thereby rolls over bottom 245 of a side chamber 219 formed in clamping member 249. Displacing members 218 are here also formed by the outer ends of a rod 224 which protrudes through a bore 222 in mounting part 205 and is mounted in a bearing 226.

In yet another embodiment of upper tool 301 according to the invention the mounting part 305 is provided with two types of displacing member 318A, 318B protruding on mutually opposite sides from side walls 346 (FIGS. 18-20). Displacing members 318A, two of which are shown here, are each rotatable here about an axis A extending transversely of shaping direction W, so in the shown embodiment horizontally. The single displacing member 318B is on the other hand pivotable about an axis B extending in the shaping direction W of tool 301, so in the shown embodiment a vertical axis.

The two displacing members 318A are arranged here between groove 320 and the "shoulder" 309 of tool 301, while the single displacing member 318B is placed close to end surface 377 of mounting part 305. In this embodiment of upper tool 301, which is referred to as "head-supporting", the "shoulders" 309 do not engage with lower surfaces 310 of upper beam 303 during the clamping. Tool 301 instead supports in the clamped situation with its end surface 377 against an upper surface 378 of receiving space 306. Displacing members 318A are once again received in two through-bores 332 and mounting part 305, while the single displacing member 318B is received in an elongate recess 350 in mounting part 305. This displacing member 318B is rotatable around a shaft stub 351 placed in a bore 352 in the end surface of mounting part 305.

The two displacing members 318A rotatable about horizontal axes A are again intended to roll over bottom 345 of a side chamber 319 of receiving space 306. Displacing member 318B rotatable about vertical axis B is on the other hand intended to roll along a side wall 353 of receiving space 306 (FIG. 21). This arrangement of the displacing members is advantageous, since the centre of gravity of tool 301, which is also referred to as a "tub tool", lies in the shown embodiment quite far out of the line of mounting part 305. This is a result of the convex form of shaping part 307. Placing of the displacing member 318B rotatable about the vertical axis B and supporting against side wall 353 of receiving space 306 compensates the moment resulting from the eccentric location of the centre of gravity. Because this displacing member 318B can moreover be larger than displacing members 318A, which are received in the relatively small side chambers 319, the force exerted on displacing member 318B is relatively small, whereby the friction also remains limited.

This variant, wherein two different types of displacing member are combined, could also be readily applied in tools with other types of clamping, such as for instance the "European style" upper tool 201 as shown in FIG. 17. One of the two (partially) protruding displacing members 218 could then be replaced here by a displacing member which protrudes outside one of the side surfaces 246 and is rotatable about a vertical axis.

In yet another variant of this embodiment shown in FIGS. 22-24 the displacing members 418A rotatable about horizontal axes A are retractable into mounting part 405. Each displacing member 418A is for this purpose mounted rotatably via bearing 426 in a slide 454, which is in turn mounted slidably in a recess 455 extending in both mounting part 405 and, partially, in shoulder 409. Each slide 454 comprises an upper part 456 which supports bearing 426 and displacing member 418A, a middle part connected to a guide member 457 and a lower part 458 protruding outside the tool and functioning as operating member or pushbutton.

Guide member 457 has a narrow shank which protrudes through an opening 462 and a widened head which cannot pass through this opening and functions as stop. This widened head is slidable in a bore 459 lying opposite recess 455. Slide 454 with displacing member 418A is biased to its protruding position by means of a biasing member 460 received in a chamber 461.

Pressing operating member 458 (FIG. 24A) presses slide 454 into recess 455 counter to the force of biasing member 460, whereby displacing member 418A comes to lie within the periphery of mounting part 405. In this position the mounting part 405 can be inserted into the receiving space (not shown here) of the apparatus. When operating member 458 is then released, slide 454 is pressed outward again by biasing member 460 (FIG. 24B), whereby displacing member 418A once again engages in the side chamber of the receiving space in the above described manner.

Displacing member 418A thus functions simultaneously as safety catch which prevents tool 401 from unintentionally falling out of the apparatus when the clamping is released. In order to remove tool 401 from recess 406 the operating member 458 has to be pressed once again, whereby the associated displacing member 418A is retracted again into mounting part 405.

It has been stated above that for displacement of the lower tool in the lower beam use can be made of displacing members protruding from the end surface of the mounting parts and rolling over a bottom of a recess in the lower beam. So as not to load these displacing members when the lower tool is used for the purpose of shaping plate material, these members must come to lie clear of the bottom of the recess following the displacement. According to an alternative embodiment of lower tool 502, the mounting parts 511 in which displacing members 532 are mounted are for this purpose movable in the shaping direction relative to the rest of lower tool 502 (FIGS. 25, 26).

Mounting part 511 is slidable in the shaping direction in groove 516 on the underside of lower tool 502. Formed in shaping part 513 of tool 502 is a bore 563 which extends from the bottom 564 of V-shaped groove 514 to groove 516. Received in this bore 563 is a control pin 530 with a head 565 on which a tool, for instance a socket wrench or a screwdriver, can engage and which has a narrowed threaded end 566. This threaded end 566 protrudes into hole 531 in mounting part 511 which is provided with internal screw thread. Mounting part 511 and shaping part 513 are further also provided with blind bores 568, 569 which lie mutually in line and in which a guide pin 567 is received.

By rotating the control pin 530 the mounting part 511 is pressed further out of groove 516 relative to shaping part 513 or, conversely, retracted therein again. Displacing members 532 can hereby as desired be brought into engagement with the bottom of the recess of the lower clamping beam (not shown here) or, conversely, be held clear thereof again.

Because it is not always readily possible in practice, and moreover unsafe, to perform operations with a screwdriver or socket wrench in a hole in the bottom 564 of V-shaped groove 514, an alternative embodiment of lower tool 602 is provided with an operating mechanism which is accessible from the side of the tool (FIGS. 27-29).

In this embodiment two stepped bores 668 are formed in each mounting part 611 which lie in line with blind bores 669 in shaping part 613 of lower tool 602. Arranged in these bores are guide pins 667 which are screwed with their threaded ends into bores 669. These guide pins 667 have a thickened head which is movable through the widened part of bore 668 and which encloses a biasing member 672, for instance a helical spring. A bore 663 in which a control pin 630 is slidably received is further formed in shaping part 613 between bores 669. An outer end of this control pin 630 engages on the upper side of mounting part 611 while the other outer end is in engagement with a narrowed and eccentric middle part 671 of a horizontal operating rod 673.

This rod 673 is received in a bore 670 extending from the one side to the other of lower tool 602 and provided on either side with a head 665 on which a tool such as a socket wrench or screwdriver can engage. Rotation of operating rod 673 displaces the narrowed and eccentric middle part 671 in bore 670, whereby pin 630 is pressed out of lower tool 602 or, conversely, space is created to retract this pin 630 into the lower tool. This retracting movement takes place under the influence of biasing members 672 as soon as operating rod 673 is rotated so far that space is created for pin 630 to move upward in bore 663. Displacing members 632 are in this way once again brought into contact with the bottom of the recess in the lower beam or held clear thereof as desired.

A pneumatic or a hydraulic operation could of course also be envisaged instead of the mechanical operation shown and described here for extending and retracting the displacing members.

Although in the embodiments of the upper tool shown up to this point the displacing members have been bearing-mounted in the mounting part, this is not essential. In an alternative embodiment of upper tool 701 the mounting part 705 can thus be provided with one or more protruding displacing members 718A, while one or more displacing members 718B are additionally arranged on shaping part 707 of tool 701 (FIGS. 30-32).

Where displacing members 718A, which are bearing-mounted in mounting part 705, once again engage in side chambers 719 of receiving space 706 of upper beam 703 of the apparatus, displacing members 718B engage on support surface 710 on the underside of upper beam 703. As in previous embodiments, these outer displacing members 718B, which can take a considerably larger form than the internal displacing members 718A, serve to compensate the moment occurring as a result of the eccentric location of the centre of gravity of tool 701. The external displacing members 718B are thus arranged for this purpose on the other side of tool 701, opposite the internal displacing members 718A, which in fact define rotation points when tool 701 is placed in receiving space 706 of upper beam 703. Each external displacing member 718B comprises a relatively large roller 774 which is rotatable about a strong shaft 775.

The external displacing member 818B can also be received in a protruding part 876 of upper tool 801. This member is hereby better protected from ambient influences, whereby a smooth running with little friction is guaranteed under any conditions.

A similar solution could also be used in a lower tool, where one or more displacing members could be arranged in the shoulder(s) adjacently of the protruding mounting part, or even on the sides of the tool.

The invention thus makes it possible with relatively simple means to clamp large and heavy tools, which are used to shape relatively thick metal plate, at a desired position in an apparatus or to remove them therefrom.

Although the invention has been elucidated above on the basis of different embodiments, it will be apparent that it is not limited thereto. Depending on the dimensions and the weight of the tool, a greater or smaller number of displacing members could thus be applied than shown and described here. It is further possible to envisage use being made, instead of rolling displacing members, of displacing members which slide through or along the upper and lower beam. The displacing members and/or the receiving spaces and/or the outer surfaces of the upper and lower beam would have to be covered for this purpose with a material with exceptionally low sliding resistance, such as for instance PTFE.

The scope of the invention is therefore defined solely by the following claims.

The invention claimed is:

1. Tool for shaping a material, in particular for bending plate material, comprising:

a mounting part configured to be at least partially received in a receiving space of an apparatus, a shaping part extending from the mounting part, at least one displacing member that protrudes from the tool and is configured to displace the mounting part in a longitudinal direction through the receiving space, and a bearing at an interface between the tool and the at least one displacing member, wherein the at least one displacing member is configured to rotate relative to the tool as a result of the bearing.

2. Tool as claimed in claim 1, characterized in that the mounting part has two side surfaces and the at least one displacing member protrudes out from at least one of the side surfaces.

3. Tool as claimed in claim 2, characterized in that the at least one displacing member protrudes out from each side surface.

4. Tool as claimed in claim 3, characterized by a single displacing member running through the mounting part.

5. Tool as claimed in claim 1, characterized in that the at least one displacing member is retractable into the mounting part.

6. Tool as claimed in claim 5, characterized by an operating member connected to the at least one displacing member.

7. Tool as claimed in claim 1, characterized in that the mounting part has an end surface from which the at least one displacing member protrudes.

8. Tool as claimed in claim 7, characterized in that the at least one displacing member is movable in the shaping direction relative to the tool.

9. Tool as claimed in claim 1, characterized in that the at least one displacing member protrudes from the shaping part.

10. Tool as claimed in claim 1, wherein the at least one displacing member includes a first displacing member and a second displacing member, characterized by the first displacing member protruding from the mounting part and the second displacing member protruding from the shaping part.

11. Tool as claimed in claim 1, wherein the at least one displacing member includes a plurality of protruding displacing members distributed in a longitudinal direction of the tool.

12. Tool as claimed in claim 1, characterized in that the at least one displacing member comprises a rod received in a bore in the tool and the bearing comprises an external bearing between the rod and the bore.

13. Tool as claimed in claim 1, characterized in that the at least one displacing member comprises a shaft and the bearing comprises a roller arranged rotatably on the shaft.

14. Tool as claimed in claim 1, characterized in that the at least one displacing member is rotatable about an axis extending in transverse direction of the tool and transversely of the shaping direction of the tool.

15. Tool as claimed in claim 1, characterized in that the at least one displacing member is rotatable about an axis extending in the shaping direction of the tool.

16. Tool as claimed in claim 1, characterized by at least two displacing members, one of which is rotatable about an axis extending in transverse direction of the tool and transversely of the shaping direction of the tool and another of which is rotatable about an axis extending in the shaping direction of the tool.

17. Combination of an apparatus and a tool for shaping a material, in particular for bending plate material, the tool comprising:

a mounting part configured to be at least partially received in a receiving space of an apparatus, and a shaping part extending from the mounting part, at least one displacing member that protrudes from the tool and is configured to displace the mounting part in a longitudinal direction through the receiving space, and a bearing at an interface between the tool and the at least one displacing member, wherein the at least one displacing member is configured to rotate relative to the tool as a result of the bearing, wherein the apparatus includes a receiving space in which the mounting part of the tool is received, characterized in that the receiving space comprises a wall part on which the at least one displacing member engages.

18. Combination as claimed in claim 17, characterized in that the apparatus and the tool are configured to hold the at least one displacing member clear of the wall part during shaping.

19. Combination as claimed in claim 18, characterized in that the wall part and the at least one displacing member are movable relative to each other between a rest position, in which they lie spaced apart, and an operative position in which the at least one displacing member and the wall part mutually engage.

20. Combination as claimed in claim 19, characterized in that the at least one displacing member is received in a stationary manner in the tool and the wall part is movable in the apparatus between the rest position and the operative position.

21. Combination as claimed in claim 20, characterized by a drive for moving the wall part between the rest position and the operative position.

22. Method comprising:

positioning a tool within an apparatus, the tool comprising:

a mounting part, a shaping part extending from the mounting part, at least one displacing member that protrudes from the tool and is configured to displace the mounting part in a longitudinal direction through a receiving space of the apparatus, and a bearing at an interface between the tool and the at least one displacing member, wherein the at least one displacing member is configured to rotate relative to the tool as a result of the bearing, wherein the tool is positioned within the apparatus by at least partially receiving the mounting part in the receiving space of the apparatus and moving the tool in the longitudinal direction to a desired position.

23. Method as claimed in claim 22, characterized in that the at least one displacing member is moved over a wall part of the apparatus.

24. Method as claimed in claim 23, characterized in that the receiving space includes the wall part.

25. Method as claimed in claim 24, characterized in that the at least one displacing member is retractable and is retracted into the mounting part before the mounting part is received in the receiving space.

26. Method as claimed in claim 23, characterized in that the at least one displacing member protrudes from the shaping part and is moved over an outer wall of the apparatus.

27. Method as claimed in claim 23, characterized in that the at least one displacing member is rolled over the wall part of the apparatus.

28. Method as claimed in claim 23, characterized in that the at least one displacing member and the wall part are moved away from each other when the tool has reached a desired position.

29. Tool as claimed in claim 1, wherein the mounting part and the shaping part comprise a unitary structure.

30. Tool as claimed in claim 1, wherein the tool is configured to avoid the at least one displacing member being loaded when the tool shapes the material.

* * * * *